US008512034B2

(12) United States Patent
Young et al.

(10) Patent No.: US 8,512,034 B2
(45) Date of Patent: Aug. 20, 2013

(54) GAS PILOT BURNER ASSEMBLY

(75) Inventors: Gregory Young, Richfield, MN (US); Donald J. Kasprzyk, Maple Grove, MN (US)

(73) Assignee: Honeywell International Inc., Morristown, NJ (US)

( * ) Notice: Subject to any disclaimer, the term of this patent is extended or adjusted under 35 U.S.C. 154(b) by 1031 days.

(21) Appl. No.: 12/546,531

(22) Filed: Aug. 24, 2009

(65) Prior Publication Data

US 2011/0045423 A1 Feb. 24, 2011

(51) Int. Cl.
*F23Q 7/06* (2006.01)

(52) U.S. Cl.
USPC ..... 431/258; 431/343; 431/80; 431/264; 431/263; 431/78; 136/217; 136/230

(58) Field of Classification Search
USPC ..... 431/258, 343, 80, 264, 263, 78, 278; 136/217, 230
See application file for complete search history.

(56) References Cited

U.S. PATENT DOCUMENTS

| | | | | |
|---|---|---|---|---|
| 2,609,870 | A | 9/1952 | Riebman et al. | |
| 2,753,930 | A * | 7/1956 | Fleury | 431/80 |
| 3,052,286 | A | 9/1962 | Kramer et al. | |
| 3,208,505 | A * | 9/1965 | Craemer | 431/80 |
| 3,825,183 | A | 7/1974 | Machlanski | |
| 4,165,963 | A | 8/1979 | Nozaki | |
| 4,325,690 | A * | 4/1982 | Hayes | 431/78 |
| 4,337,029 | A * | 6/1982 | McElroy et al. | 431/264 |
| 4,565,521 | A | 1/1986 | Hancock | |
| 4,783,029 | A * | 11/1988 | Geppert et al. | 248/74.1 |
| 5,613,830 | A | 3/1997 | Chan et al. | |
| 6,059,562 | A * | 5/2000 | Anderson, II | 431/80 |
| 7,300,278 | B2 | 11/2007 | Vandrak et al. | |

FOREIGN PATENT DOCUMENTS

| | | |
|---|---|---|
| GB | 207311 | 11/1923 |
| GB | 956326 | 4/1964 |

OTHER PUBLICATIONS

Katherine M. Devries Smith, "Description of Honeywell Q5000 Water Heater Pilot Hardware," 10 pages, at least as early as Jul. 16, 2007.

* cited by examiner

*Primary Examiner* — Avinash Savani
(74) *Attorney, Agent, or Firm* — Seager Tufte & Wickhem LLC.

(57) ABSTRACT

A pilot burner assembly for easy removal of a thermo-electric or other device is disclosed. In an illustrative embodiment, a burner tube, thermo-electric device, and/or spark source are retained in a desired position via a bracket and resilient clip. The bracket may include retention features built into the bracket to help aid in the positioning of the burner tube, thermo-electric device, and/or spark source. The burner tube, thermo-electric device and/or spark source may include retention features that are configured to engage corresponding retention features in the bracket, when desired. The resilient clip may bias the retention features of the burner tube, thermo-electric device and/or spark source against corresponding the retention features of the bracket. One or more of the burner tube, thermo-electric device and/or spark source may be removed from the bracket by overcoming the bias force provided by the resilient clip to disengage the retention features of the burner tube, thermo-electric device and/or spark source from the corresponding retention features of the bracket, and sliding the component out of the bracket.

20 Claims, 9 Drawing Sheets

GAS PILOT BURNER ASSEMBLY

TECHNICAL FIELD

The present disclosure relates generally to gas-fired burner assemblies, and more particularly, to pilot burner assemblies for gas-fired appliances.

BACKGROUND

Gas-fired appliances that cycle on and off often have a pilot burner that provides a flame whose purpose is to light the main burner of the appliance when there is a call for heat. In some cases, pilot burners can also provide a safety control mechanism to help ensure that if the pilot flame is extinguished for any reason, then the supply of gas to the whole appliance is cut off.

Pilot burners for gas-fired appliances often include a pilot burner tube which defines a flame opening at one end, a thermo-electric device and a spark source. The relative alignment and/or positioning of the various components of a pilot burner can affect the operation and/or reliability of the pilot burner. In some cases, several machined parts, fixtures, and/or assembly tools are required to help ensure that the pilot burner's functional tolerances are maintained, which can be expensive. Also, it can be desirable to allow a technician or other person to remove and/or replace one or more of the components of a pilot burner in the field. In many cases, this can be difficult and time consuming given the construction of many conventional pilot burners.

SUMMARY

The present disclosure relates generally to gas-fired burner assemblies, and more particularly, to pilot burner assemblies for gas-fired appliances. In one illustrative embodiment, a pilot burner assembly is provided that includes a bracket and a resilient clip for maintaining pilot burner components in a desired configuration. In one illustrative embodiment, the bracket may include a first plate, a spaced second plate, and a third plate connecting the first plate to the second plate, and in some cases, generally U-shaped. The first plate and the second plate may each define a first aperture for receiving a burner tube. The first plate and the second plate may also each define a second aperture for receiving a thermo-electric device. A resilient clip may be used to secure the burner tube and the thermo-electric device within the first and second apertures of the bracket. The clip may be positioned between the first and second plates, and may hold the burner tube and the thermo-electric device in place relative to the bracket. This is just one example, and more generally, it is contemplated that such a bracket and resilient clip assembly may be used to more easily assembly, remove and/or replace one or more components of a pilot burner assembly.

BRIEF DESCRIPTION OF THE DRAWINGS

The invention may be more completely understood in consideration of the following detailed description of various illustrative embodiments in connection with the accompanying drawings, in which.

Figure 1:
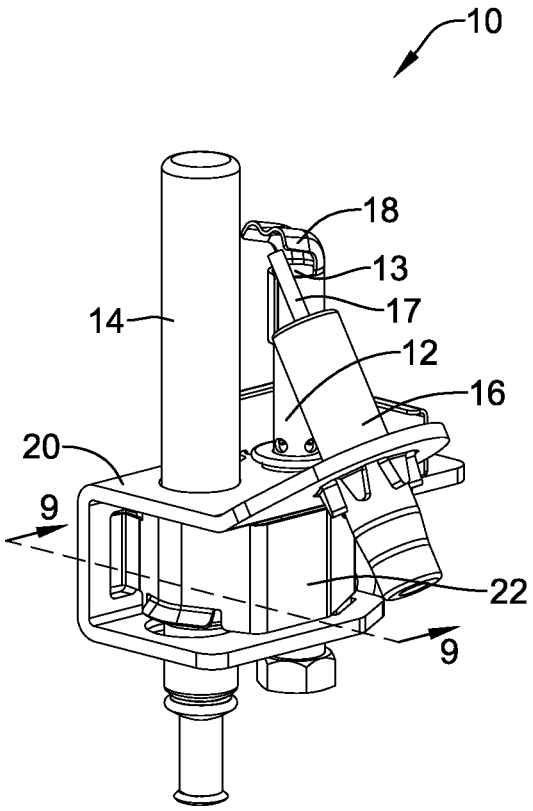
FIG. 1 is a perspective view of an illustrative pilot burner assembly.

While the invention is amenable to various modifications and alternative forms, specifics thereof have been shown by way of example in the drawings and will be described in detail. It should be understood, however, that the intention is not to limit aspects of the invention to the particular embodiments described. On the contrary, the intention is to cover all modifications, equivalents, and alternatives falling within the spirit and scope of the invention.

DESCRIPTION

The following description should be read with reference to the drawings wherein like reference numerals indicate like elements throughout the several views. The description and drawings show several illustrative embodiments which are meant to be illustrative of the claimed invention.

FIG. 1 is a perspective view of an illustrative pilot burner assembly 10. In FIG. 1, the illustrative assembly 10 includes a burner tube 12, a thermo-electric device 14, and a spark source 16. The burner tube 12 defines a flame opening 13 at a first end, and a connection to a gas supply (e.g. to an output of a gas valve) at a second opposing end. In the illustrative embodiment shown, the first end of the burner tube 12 includes a hood assembly 18 disposed over the burner tube 12 for directing the flame towards a thermo-electric device 14.

The thermo-electric device 14 may, for example, be a thermopile. It is contemplated that the thermo-electric device 14 may be any suitable thermoelectric device including a thermocouple or thermopile, as desired. A thermopile is a device that converts thermal energy into electrical energy. It is composed of thermocouples either connected in series or in parallel. For the pilot burner 10, it is possible for a single thermocouple to be used instead of a thermopile, but it is more common for a collection of thermocouples such as a thermopile to be used with a pilot burner. When a flame is present at the flame opening 13 of the burner tube 12, the flame or heat from the flame is directed to the body of the thermo-electric device 14, sometimes with the aid of hood assembly 18. The thermo-electric device 14 then generates a current. The current may be directed to a gas valve that supplies gas to a corresponding gas fired appliance. A lack of current from the thermo-electric device 14, which would indicate a lack of a pilot flame in pilot burner assembly 10, may be used to disable the gas valve. In this way, the pilot burner 10 may provide an interlock safety mechanism for the flow of gas to a gas fired appliance. In some cases, the thermoelectric device may be a photo-electric device, which may generate a current based on light emitted from the pilot flame, rather than heat.

In the illustrative embodiment, the burner tube 12 is positioned generally parallel to the thermo-electric device 14, although this is not required. This assembly orientation may be maintained using a bracket 20 and a resilient clip 22. The bracket 20 may be formed from stamped metal, if desired. When so provided, certain features such as first and second apertures, may be formed when the bracket is "blanked". If certain features "float" during the stamping operation, such as first and second apertures, they will tend to float together and their positions may remain relatively fixed with respect to each other. This may help maintain the functional tolerances of the pilot burner components. In the illustrative embodiment, the bracket 20 may be generally "U" shaped, and may include retention features on one or both legs of the U-channel for maintaining the burner tube 12 and thermoelectric device 14 in a desired orientation. This may allow tighter tolerances on the functional dimensions to be maintained, without requiring adjustment or complicated fixtures in the factory or in the field.

Figure 2:
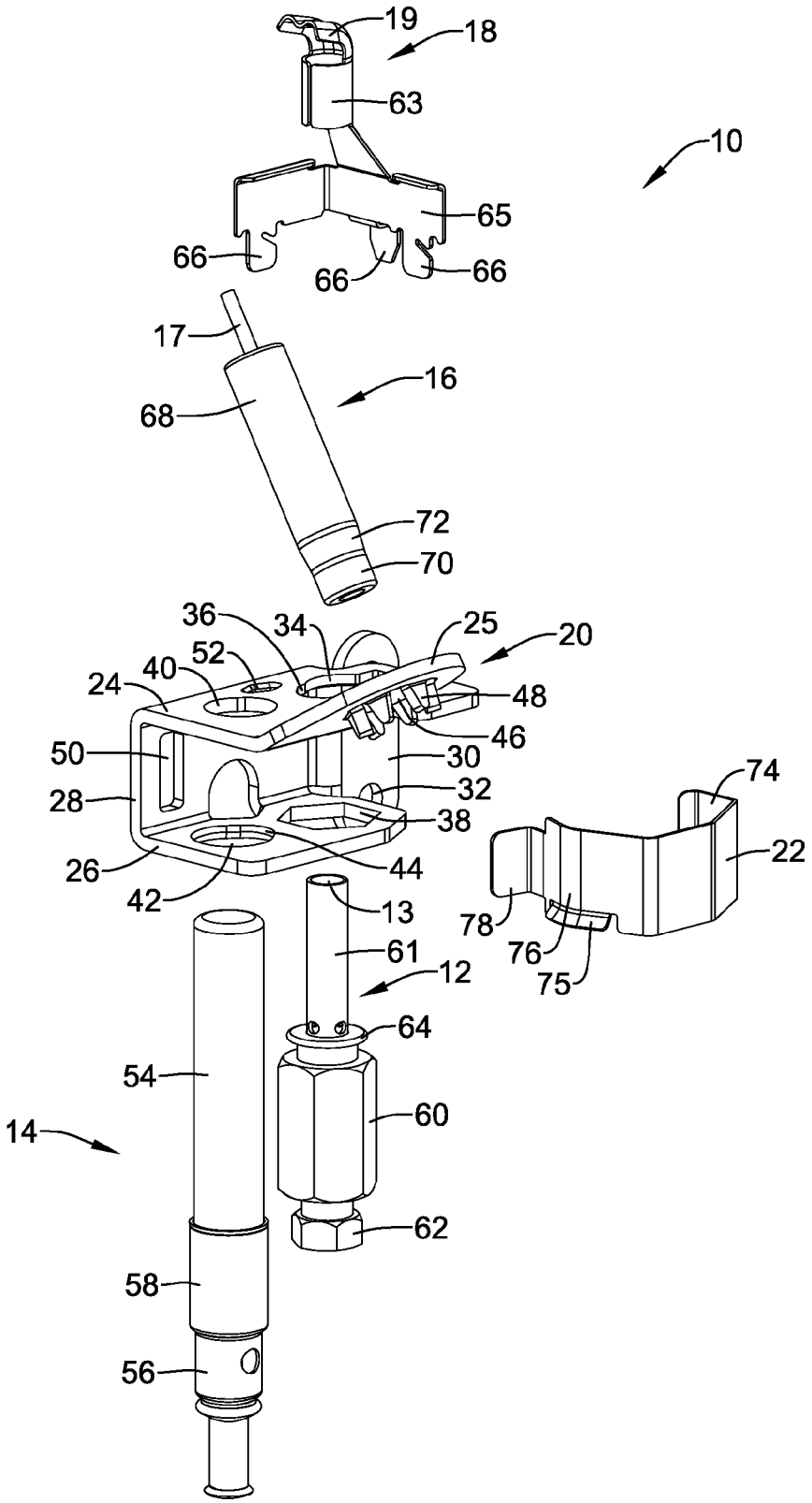
FIG. 2 is an exploded view of the illustrative pilot burner assembly of FIG. 1.
Figure 3:
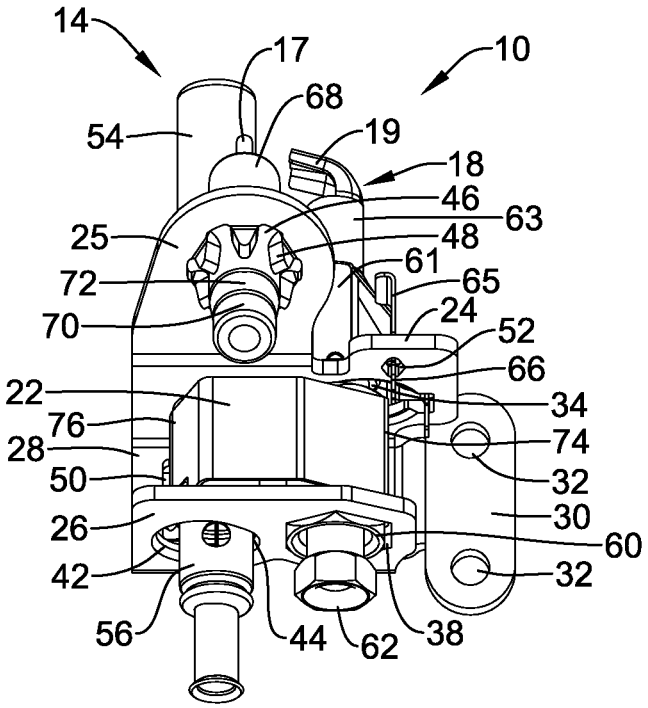
FIG. 3 is an alternative perspective view of the illustrative pilot burner assembly of FIG. 1.

The various components of the illustrative pilot burner assembly 10 will now be described in more detail with reference to FIGS. 2 and 3. FIG. 2 is an exploded view of the illustrative pilot burner assembly 10 of FIG. 1, and FIG. 3 is an alternative perspective view of the illustrative pilot burner assembly 10 of FIG. 1. In the illustrative embodiment, and as best shown in FIG. 2, the bracket 20 may have a general "U channel" shape that is defined by a first plate 24 and a spaced second plate 26, with a third plate 28 extending between the first plate 24 and the second plate 26. The third plate 28 may be positioned perpendicular to the first and second plates 24, 26, but this is not required.

The first plate 24 may include a first aperture 34 and a second aperture 40. The second plate 26 may include a first aperture 38 and a second aperture 42. The first aperture 34 of the first plate 24 may be generally aligned with the first aperture 38 of the second plate 26, and the second aperture 40 of the first plate 24 may be generally aligned with the second aperture 42 of the second plate 26. The first apertures 34, 38 may be configured to receive the burner tube 12 therethrough. The second apertures 40, 42 may be configured to receive the thermo-electric device 14 therethrough. While apertures 34, 40, 42 are shown as having a generally circular cross-section with "v-block" features for component alignment, it is contemplated the cross-section may be of any shape desired.

In one example, aperture 34 in the first plate 24 may include a retention feature 36 for cooperating with a retention feature 64 of the burner tube 12 (see FIG. 2). The retention feature 36 may include a region of reduced profile relative to the aperture 34 configured to provide a hard stop and engage the retention feature 64 of the burner tube 12 to maintain the burner tube 12 in a desired position relative to the other burner assembly components, as will be discussed in more detail below. In the illustrative embodiment, aperture 38 in the second plate 26 includes a hexagonal shape that is configured to engage the spud 60 of the burner tube 12. In the illustrative embodiment, the first plate 24 also includes an additional aperture or a plurality of apertures 52 to engage retention features 66 of the hood assembly 18.

Aperture 42 in the second plate 26 may include a retention feature 44 for cooperating with a retention feature 58 of the thermo-electric device 14. The retention feature 44 may include a region of reduced profile (see FIG. 3) relative to the aperture 42 to provide a hard stop and to engage the retention feature 58 of the thermo-electric device 14. This may help maintain the thermo-electric device 14 in a desired position relative to the other burner assembly components, as will be discussed in more detail below. In the illustrative embodiment, the third plate 28 includes an aperture 50 for receiving a retention feature 78 of the resilient clip 22.

Referring to FIGS. 2 and 3, the bracket 20 may include a fourth portion 30 that defines openings 32 for mounting the bracket 20 to another structure, such as to a gas-fired appliance. While the fourth portion 30 is shown as extending from third plate 28, is contemplated that the fourth portion 30 may extend from any of the bracket surfaces 24, 26, 28 desired. The bracket 20 may further include an angled plate 25 extending from the first plate 24, as shown. The angled plate may include an aperture 46 configured to receive spark source 16. The angled plate 25 may be positioned to orient the spark source 16 towards the flame opening 13 of the burner tube 12. Spark source 16 may include a spark rod 17 extending towards the flame opening 13 of the burner tube 12. The aperture 46 may include "finger" like protrusions 48 that are configured to engage the spark source 16 and maintain the spark source 16 in a desired position relative to the burner tube 12.

Referring specifically to FIG. 2, the thermo-electric device 14 may include a first region 54 having a first cross-sectional area. In some embodiments, the cross-sectional area of the first region 54 may be approximately equal to the cross-sectional area of apertures 40, 42. In other embodiments the cross-sectional area of the first region 54 may be smaller than the cross-sectional area of the aperture 40, 42. In some cases, the thermo-electric device 14 may include a second region 56 having a second cross-sectional area. The second cross-sectional area may be smaller than, the same as, or larger than the first cross-sectional area, as desired. Disposed between the first region 54 and the second region 56 may be a third region, or sometimes referred to as a retention feature 58, that has a cross-sectional area that is larger than the first cross-sectional area.

The burner tube 12 may include a first end 61 adjacent to the flame opening 13, and a second end 62 configured to be connected to a gas line. The second end 62 may include a threaded burner nut or other connection element for connecting the burner tube 12 to a gas line. A spud 60 may be disposed adjacent the second end 62. In the illustrative embodiment, the spud 60 has a hexagonal shape to generally correspond with hexagonal shape aperture 38. It is contemplated that in some embodiments, the spud 60 and aperture 38 may have a different shape such as, for example, circular, rectangular, square, polygonal, etc.

The hexagonal (or other) shape of spud 60 and aperture 38 may allow the burner nut 62 to be loosened and/or tightened without having to grip the spud 60 or other parts of the burner tube 12 with a wrench or other holding device. In the illustrative embodiment, the bracket 20 (e.g. aperture 38) itself may act as the holding device. The burner tube 12 may include a retention feature 64 disposed adjacent the first end 61. The retention feature 64 of the burner tube 12 may include an area of increased diameter relative to the first end 61, which will be described in more detail with respect to FIG. 6.

In the illustrative embodiment, the hood assembly 18 may include an L-shaped bracket 65 for connecting the hood assembly 18 to the bracket 20. The L-shaped bracket 65 may include tabs 66 for engaging apertures 52 in the bracket 20. While the hood assembly 18 is shown as having three tabs 66, it is contemplated that the hood assembly 18 may have as many or as few tabs as desired to maintain the hood assembly 18 in a desired position relative to the burner tube 12 and/or bracket 20.

As shown, the hood assembly 18 includes a tubular structure 63 configured to be disposed over the first end 61 of the burner tube 12. The tubular structure 63 may have a slit disposed down the middle such that the tubular structure 63 may be a bit smaller than the first end 61 of the burner tube 12, and may expand to form a frictional fit around the first end 61 of the burner tube 12. In some embodiments, the inner diameter of the tubular structure 63 may be slightly larger than the first end 61 of the burner tube 12. In some embodiments, the tubular structure 63 may not be included. In the illustrative embodiment, the hood assembly 18 includes a hood 19 attached to the tubular structure 63. The hood 19 is configured to direct the flame from the burner tube 12 towards the thermo-electric device 14.

In the illustrative embodiment, the spark source 16 includes a generally tubular structure having a first end 68 and a second end 70, with a tapered region 52 disposed therebetween. The first region 68 may have a cross-sectional area that is larger than the second region 70. As will be discussed in more detail with respect to FIG. 7, the first region 68 may be received by apertures 48 on the angled portion 25 of the bracket 20. One example of a spark source that can be used with the pilot burner is a piezoelectric sparker or other type of spark source, as desired.

In the illustrative embodiment, the resilient clip 22 includes a generally "C" shape clip, having a first region 74 configured to engage the burner tube 12 and a second region 76 configured to engage the thermo-electric device 14. The resilient clip 22 may include an inner surface and an outer surface. The inner surface of the resilient clip 22 may be configured to contact the burner tube 12 and the thermo-electric device 14. In some cases, the resilient clip 22 may include a retention feature or tab 78 that is configured to engage an aperture 50 in the third plate 28 of the bracket 20.

The resilient clip 22 may have a first generally unstressed position when the clip 22 is not positioned within the bracket 20 or around the burner tube 12 and the thermo-electric device 14. The resilient clip 22 may have a second position when positioned within the bracket 20 and around the burner tube 12 and the thermo-electric device 14. In the second position, the resilient clip 22 may be under stress and may provide a bias force to the burner tube 12 and thermo-electric device 14 against the bracket. As will be discussed in more detail with respect to FIG. 9 below, the resilient clip 22 may exert a bias force on the burner tube 12 and the thermo-electric device 14 that biases the burner tube 12 in a first direction (e.g. toward the thermo-electric device 14) and the thermo-electric device 14 in a second opposite direction (e.g. toward the burner tube 12).

The resilient clip 22 may include a "lead-in" feature 75 that may help guide the thermo-electric device 14 past the leading edge of the clip 22, and through the apertures 40, 42 during assembly. The resilient clip 22 may also include a lead-in feature (not expressly shown) to help guide the burner tube 12 past the leading edge of the clip 22 and through apertures 34, 38 during assembly.

Figure 4:
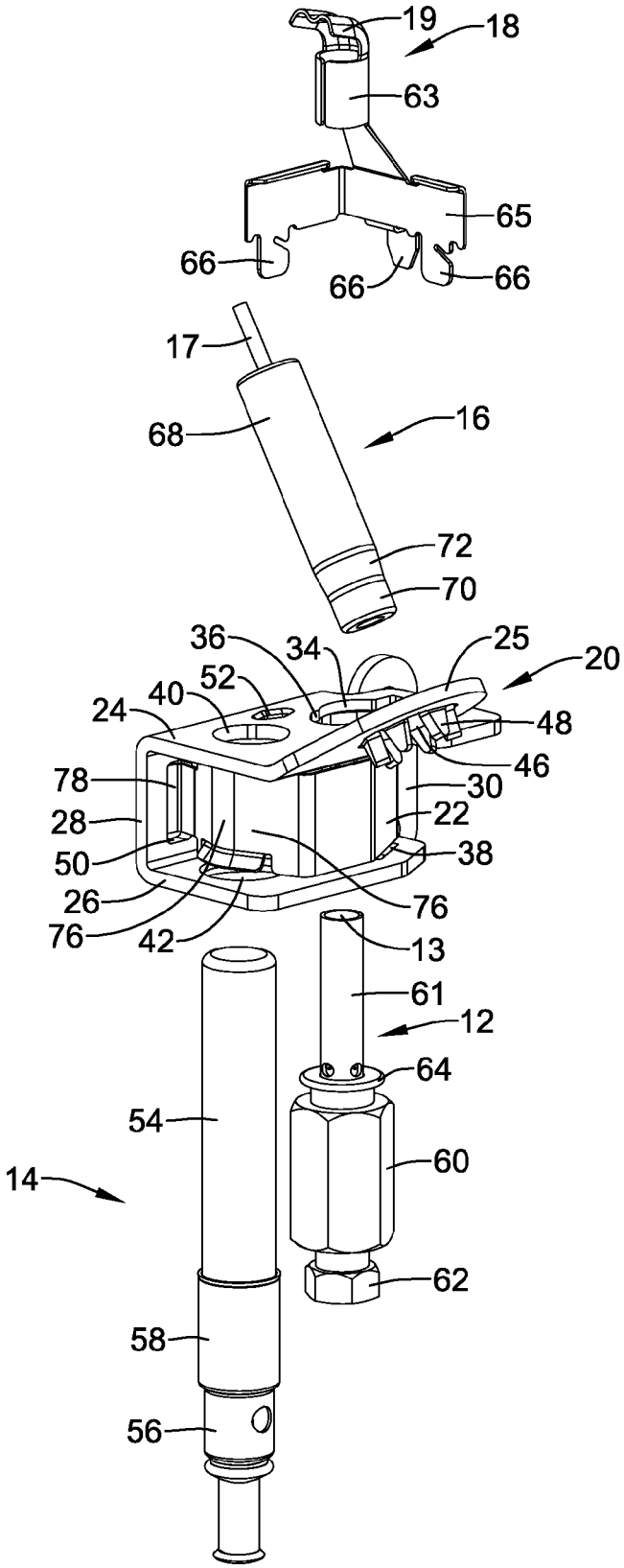
FIGS. 4-8 are exploded views of the illustrative pilot burner assembly of FIG. 1 illustrating how each component interacts with the assembly.

FIGS. 4-8 are exploded views of the illustrative pilot burner assembly of FIG. 1 illustrating how each component interacts with the assembly. Turning to FIG. 4, which illustrates the resilient clip 22 engaged within the bracket 20. The tab 78 is shown engaged or "hooked" into aperture 50 of the bracket 50 to help maintain the clip 22 within the bracket 20. For example, the interaction between tab 78 and aperture 50 may help the clip 22 remain secured within the bracket 20 even when the thermo-electric device 14 is removed from the bracket 20. This may allow for easier field replacement of the thermo-electric device 14 without tools. The tab 78 may also allow for easier insertion and removal of the clip 22 from the bracket 20. While not expressly shown, the clip 22 may include a similar tab disposed adjacent the first portion 74 (see FIG. 2) of the clip 22, but this is not required. As can be seen, the second portion 76 of the resilient clip 22 may be generally positioned adjacent aperture 42. Prior to insertion of the thermo-electric device 14 and/or the burner tube 12, the resilient clip may be in the generally unstressed state.

Figure 5:
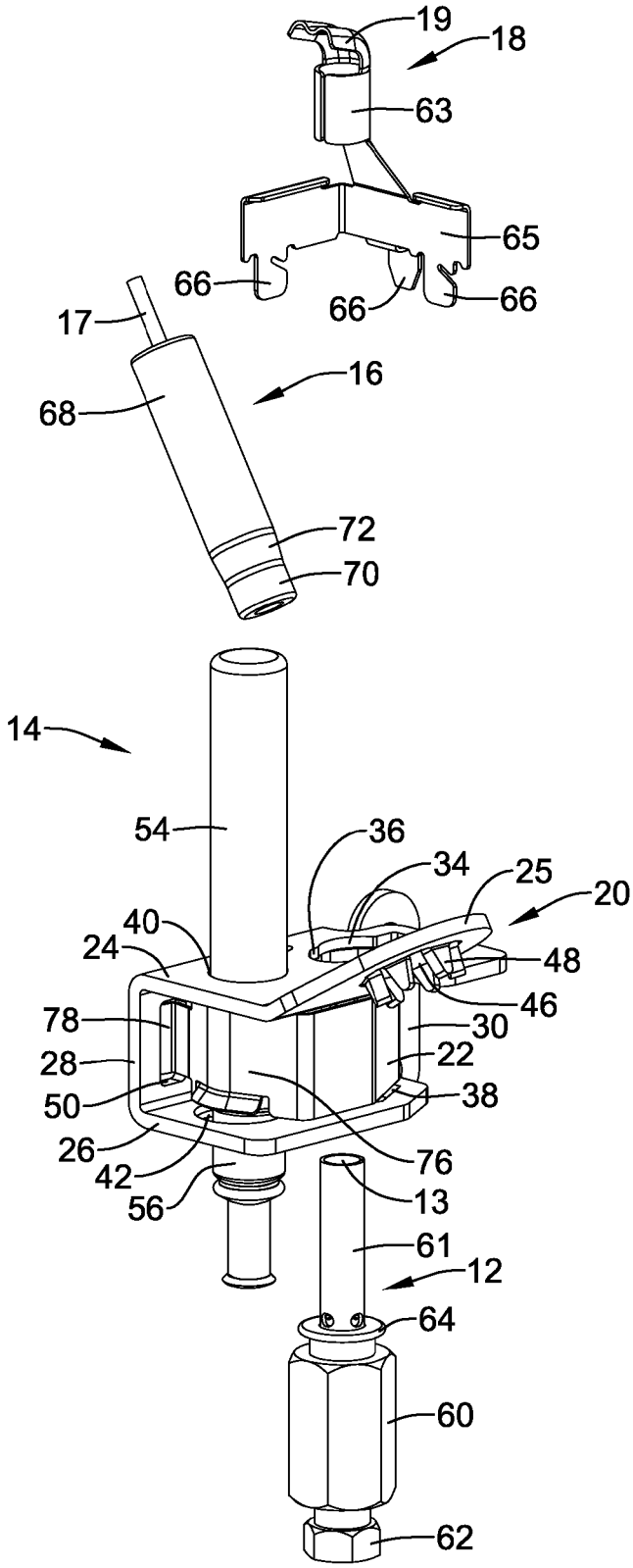

Referring now to FIG. 5, which illustrates the thermo-electric device 14 disposed within the bracket 20. In the illustrative embodiment, the thermo-electric device 14 may be positioned within the second apertures 40, 42 of the bracket 20 by applying a lateral force to the resilient clip 22 and sliding the first end 54 of the thermo-electric device 14 through aperture 42 and subsequently through aperture 40. The thermo-electric device 14 may be slid upwards through aperture 42 and 40 until a bottom portion of the retaining feature 58 slides through and is disposed above aperture 42. Once the thermo-electric device 14 is in position, the lateral force applied to the resilient clip 22 may be removed and the inner surface of the resilient clip 22 may apply a biasing force that forces the thermo-electric device 14 to engage the retaining feature 44 of the aperture 42. The retaining feature 44 of the aperture 42 may be smaller than the retaining feature 58 of the thermo-electric device 14, creating a positive stop and preventing the thermo-electric device 14 from the disassociating from the bracket 20.

The thermo-electric device 14 may also be removed from the bracket 20 in a like manner, that is, by simultaneously applying a lateral force to the resilient clip 22 and an in-line force (e.g. pulling away) to the thermo-electric device 14. This may allow the thermo-electric device 14 to be removed from the bracket 20 (without using tools) for easy field maintenance and/or replacement.

Figure 6:
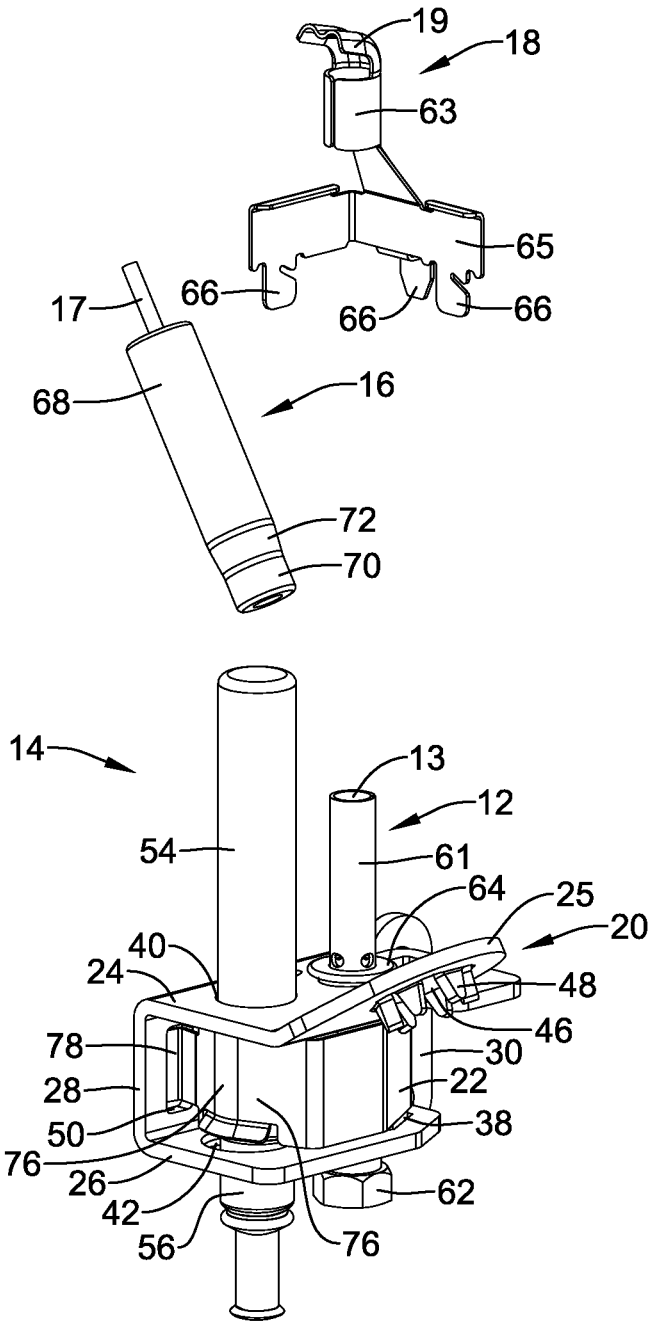

Referring now to FIG. 6, which illustrates the burner tube 12 disposed within the first apertures 34, 38 in the bracket 20. The burner tube 12 may be positioned within the bracket 20 by applying a lateral force to the resilient clip 22, and sliding the first end 61 of the burner tube 12 first through aperture 38 and then through aperture 34. The burner tube 12 may be slid upwards through apertures 38 and 34 until retaining feature 64 is disposed above aperture 34. Once the burner tube 12 is in the desired position, the lateral force applied to the resilient clip 22 may be removed and the resilient clip 22 may provide a bias force that biases the burner tube 12 toward the thermo-electric device 14, causing the retaining feature 64 of the burner tube 12 to be positioned over the retaining feature 36 of aperture 34. The retaining feature 36 of the aperture 34 may be smaller than the retaining feature 64 of the burner tube 12, creating a positive stop and preventing the burner tube 12 from disassociating from bracket 20.

The burner tube 12 may also be removed from the bracket 20 in a like manner, that is, by simultaneously applying a lateral force to the resilient clip 22 and an in-line force (e.g. pulling away) to the burner tube 12. However, in the illustrative embodiment, once the hood assembly 18 is in place, additional retention features may restrict the movement and/or removal of the burner tube 12 from the bracket, which may provide an added safety feature.

Figure 7:
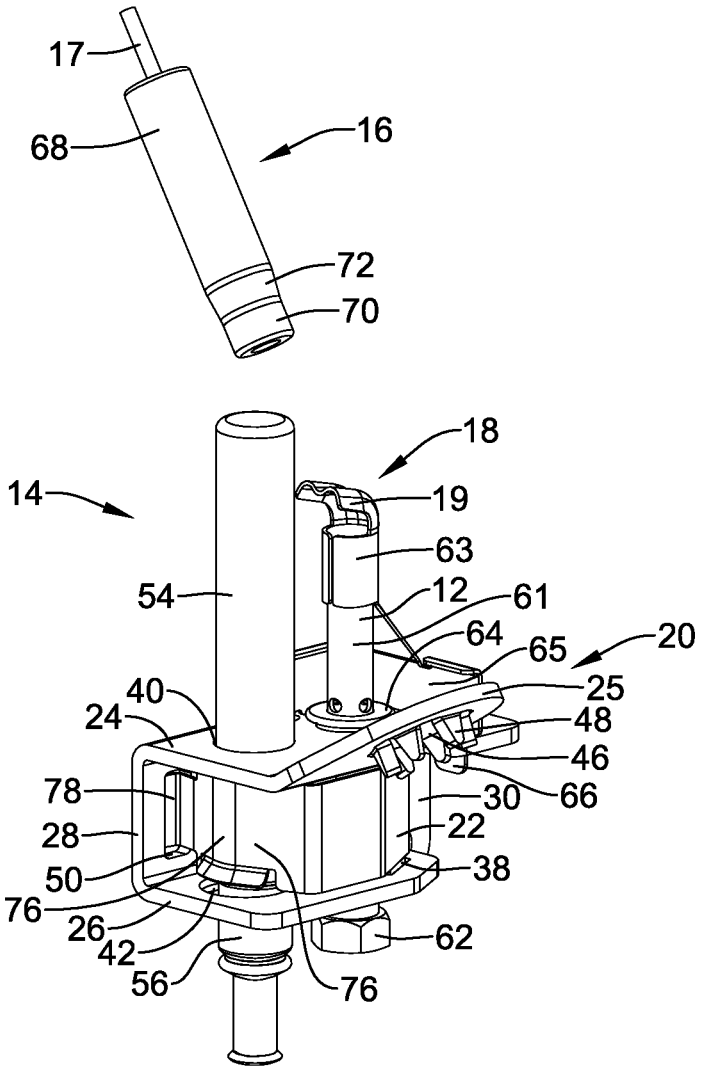

Turning to FIG. 7, which illustrates the hood assembly 18 disposed over the first end 61 of the burner tube 12 and engaged with the bracket 20. In the illustrative embodiment, the tubular structure 63 slides over the first end 61 of the burner tube 12 until tabs 66 engage apertures 52 (best shown in FIG. 3) in the bracket 20. Once the tabs 66 engage apertures 52 and the tubular structure is disposed over the first end 61 of the burner tube 12, the hood assembly 18 may prevent lateral movement of the burner tube 12. This may help prevent the removal of the burner tube 12 when the hood assembly 18 is in place. As such, and in the illustrative embodiment, the burner tube 12 may not be able to be removed without first removing the hood assembly 18. This may help prevent removal of components that are not intended to be easily removed (e.g. the burner tube), while allowing removal of components that are intended to be relatively easily replaceable (e.g. the thermo-electric device).

Figure 8:
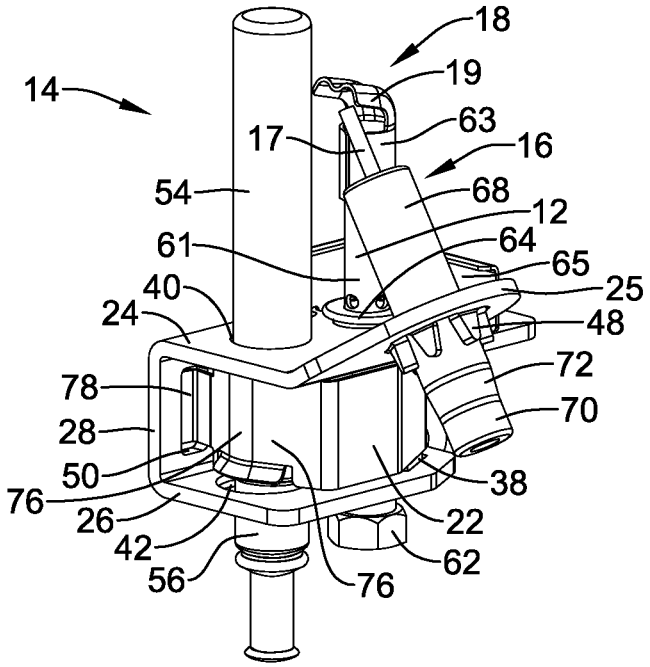

Referring now to FIG. 8, which illustrates a spark source 16 disposed within the bracket 20. The spark source 16 is shown positioned within the angled portion 25 of the bracket 20 by sliding the second region 70 of the spark source 16 through aperture 46 until the first region 68 comes into frictional engagement with apertures 48. The new frictional engagement of the first region 68 with the apertures 48 may maintain the spark source 16 in a desired position relative to the thermo-electric device 14 and burner tube 12.

Figure 9:
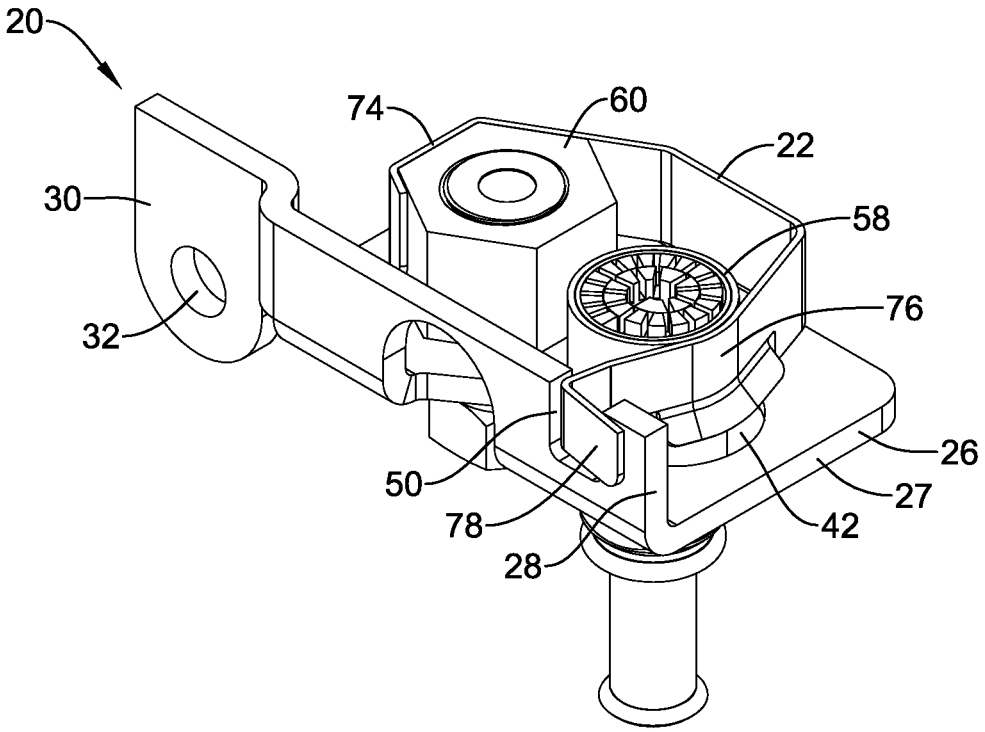
FIG. 9 is a cross-section of the illustrative pilot burner assembly of FIG. 1 taken along line 9-9.

Turning to FIG. 9, which illustrates a cross-sectional view of the illustrative burner assembly 10 of FIG. 1 taken along line 9-9. The orientation of FIG. 9 is rotated approximately 90° in the counter-clockwise direction relative to FIG. 1 in order to provide a more detailed view of the resilient clip 22 relative to the burner tube 12 and thermo-electric device 14. As can be seen, tab 78 of the resilient clip 22 is disposed within aperture 50 of the bracket 20. The tab 78 may overlap a portion of the third plate 28 to maintain the resilient clip 22 within the bracket 20 even when the thermo-electric device 14 has been removed. The first portion 74 of the resilient clip may be formed such that an inner surface may generally correspond to the corresponding side of the spud 60 of the burner tube 12. Similarly, the second portion 76 of the resilient clip 22 may be formed such that an inner surface may generally correspond with the corresponding side of the retaining feature 58 of the thermo-electric device 14. When the burner tube 12, thermo-electric device 14, and clip 22 are assembled with the bracket 20, the clip 22 may extend around the burner tube 12 and the thermo-electric device 14 such that a bias force is applied to these components forcing them towards one another. The biasing force may cause the retaining features at the burner tube 12 and retaining features at the thermo-electric device 14 to cooperate with the corresponding retaining features of the bracket 20, maintaining the burner tube 12 and thermo-electric device 14 against hard stops and in some cases at desired orientations relative to one another. The resilient clip may force the burner tube 12 and the thermo-electric device 14 towards one another and against the corresponding inner walls of their respective apertures, which may act has hard stops. As indicated above, the apertures may be formed when the bracket 20 is "blanked", and as such, if the location of the apertures "float" during the stamping operation, they will tend to float together and their positions may remain relatively fixed with respect to each other. Thus, the tolerance of the distance between the apertures may be fairly easy to control, and thus the relative positions of the burner tube 12 and thermo-electric device 14.

It is contemplated that aperture 50 may be large enough such that the second portion 76 of the resilient clip 22 may be moved laterally towards an edge surface 27 (see FIG. 8) of the bracket 20. The lateral force applied to the resilient clip 22, typically by grasping the thermo-electric device 14 and moving it towards the edge surface 27 of the bracket 20, may temporarily disengage the retaining features, such that an in-line force (e.g. pulling away) on the thermo-electric device 14 may be used to remove the thermo-electric device 14 from the bracket 20 and clip 22. This is just one example.

Those skilled in the art will recognize that the present invention may be manifested in a variety of forms other than the specific embodiments described and contemplated herein. Accordingly, departure in form and detail may be made without departing from the scope and spirit of the present invention as described in the appended claims.

What is claimed is:

1. A pilot burner assembly, comprising:

a bracket, the bracket having:

a first plate;

a second plate spaced from the first plate; and a third plate interconnecting the first plate and the second plate;

the first plate and the second plate each defining a first aperture for receiving a burner tube body therethrough;

the first plate and the second plate each defining a second aperture for receiving a thermo-electric device body therethrough;

a resilient clip, including at least a portion situated between the first plate and the second plate, for holding both the burner tube body and the thermo-electric device body in place relative to the bracket when the burner tube body and the thermo-electric device body are inserted into the first and second apertures of the first plate and second plate; and wherein, when the burner tube body and the thermo-electric device body are inserted into their respective first and second apertures of the first plate and second plate, the clip is configured to apply a bias force to the burner tube body and the thermo-electric device body such that the burner tube body and the thermo-electric device body are biased towards one another.

2. The pilot burner assembly of claim 1 wherein the clip holds both the burner tube body and the thermo-electric device body in a fixed spaced relationship relative to one another when the burner tube body and the thermo-electric device body are inserted into their respective first and second apertures of the first plate and second plate.

3. The pilot burner assembly of claim 1 wherein the bias force biases the burner tube body in a first direction and the bias force biases the thermo-electric device body in a second opposite direction.

4. The pilot burner assembly of claim 3 wherein, when the burner tube body and the thermo-electric device body are inserted into their respective first and second apertures of the first plate and second plate, the burner tube body has a first side facing in the second direction and the thermo-electric device body has a first side facing in the first direction, wherein the clip extends around and provides the bias force to the first side of the burner tube body and to the first side of the thermo-electric device body.

5. The pilot burner assembly of claim 1 wherein the first aperture of the first plate includes a retention feature and the second aperture of the first plate includes a retention feature, wherein the clip biases the burner tube body against the retention feature of the first aperture in the first plate and the clip biases the thermo-electric device body against the retention feature of the second aperture in the first plate.

6. The pilot burner assembly of claim 5 wherein the burner tube body includes a feature that cooperates with the retention feature in the first aperture of the first plate.

7. The pilot burner assembly of claim 5 wherein the thermo-electric device body includes a feature that cooperates with the retention feature in the second aperture of the first plate.

8. The pilot burner assembly of claim 1 wherein the clip includes a lead-in feature to help guide the burner tube body past the clip and through the first aperture in the second plate.

9. The pilot burner assembly of claim 1 wherein the clip includes a lead-in feature to help guide the thermo-electric device body past the clip and through the second aperture in the second plate.

10. The pilot burner assembly of claim 1 wherein the clip includes a retention feature to help retain the clip relative to the bracket even when the burner tube body and the thermo-electric device body are not inserted into their respective first and second apertures of the first plate and second plate.

11. The pilot burner assembly of claim 1 wherein the first plate, the second plate and the third plate are formed from a single piece of metal and form a U-shaped bracket.

12. A pilot burner assembly, comprising:

a bracket, the bracket having:

a first plate;

a second plate spaced from the first plate; and a third plate interconnecting the first plate and the second plate;

the first plate and the second plate each defining a first aperture for receiving a first pilot burner component body therethrough;

the first plate and the second plate each defining a second aperture for receiving a second pilot burner component body therethrough;

a resilient clip, including at least a portion situated between the first plate and the second plate, for holding both the first pilot burner component body and the second pilot burner component body in place relative to the bracket when the first pilot burner component body and the second pilot burner component body are inserted into their respective first and second apertures of the first plate and second plate; and wherein the resilient clip holds both the first pilot burner component body and the second pilot burner component body in place via a spring retention force, wherein the spring retention force is generated by deforming the resilient clip as the first pilot burner component body and the second pilot burner component body are inserted into their respective first and second apertures of the first plate and second plate and into contact with the resilient clip.

13. The pilot burner assembly of claim 12 wherein a portion of the resilient clip passes through a hole in one or more of the first, second or third plates.

14. The pilot burner assembly of claim 12 wherein the second aperture of the first plate includes a retention feature, and the second pilot burner component body includes a retention feature that cooperates with the retention feature of the second aperture of the first plate.

15. The pilot burner assembly of claim 14 wherein the second pilot burner component body can be removed from the second aperture of the first plate by moving the second pilot burner component body in a direction against the spring retention force of the resilient clip to disengage the retention feature of the second pilot burner component body from the retention feature of the second aperture while at the same time pulling the second pilot burner component body from the second aperture in the first plate.

16. A pilot burner assembly, comprising:

a u-shaped bracket having a first leg, a second leg and a third leg interconnecting the first leg to the second leg;

the first leg defining a first aperture and a second aperture;

the second leg defining a third aperture and a fourth aperture, wherein the first aperture and the third aperture are generally aligned and the second aperture and forth aperture are generally aligned;

the first aperture having a hard stop region;

the fourth aperture having a hard stop region; and a resilient clip for biasing a first pilot burner component body against the hard stop region of the first aperture and for biasing a second pilot burner component body against the hard stop region of the fourth aperture.

17. A pilot burner assembly, comprising:

a u-shaped bracket having a first leg, a second leg, and a third leg interconnecting the first leg to the second leg;

the first leg defining a first aperture and a second aperture;

the second leg defining a third aperture and a fourth aperture, wherein the first aperture and the third aperture are generally aligned and the second aperture and forth aperture are generally aligned;

the first aperture having a retention feature that is configured to cooperate with a retention feature in a first pilot burner component body;

the fourth aperture having a retention feature that is configured to cooperate with a retention feature in a second pilot burner component body; and a resilient clip for biasing a first pilot burner component body such that the retention feature in the first pilot burner component body engages the retention feature of the first aperture, and such that the retention feature in the second pilot burner component body engages the retention feature of the fourth aperture.

18. The pilot burner assembly of claim 17, wherein the resilient clip holds the retention feature in the first pilot burner component body in engagement with the retention feature of the first aperture and the retention feature in the second pilot burner component body in engagement with the retention feature of the fourth aperture via a spring retention force, wherein the spring retention force is generated by deforming the resilient clip as the first pilot burner component body and the second pilot burner component body are inserted into the u-shaped bracket.

19. The pilot burner assembly of claim 17, wherein the u-shaped bracket is formed from a single piece of sheet metal.

20. The pilot burner assembly of claim 17, wherein the first pilot burner component body includes a burner tube, and the second pilot burner component body includes a thermo-electric device.

* * * * *